US009538793B2

(12) United States Patent
Seering

(10) Patent No.: US 9,538,793 B2
(45) Date of Patent: Jan. 10, 2017

(54) UNDER BELLY SUPPORT BELT

(71) Applicant: Christine L. Seering, Lake, MI (US)

(72) Inventor: Christine L. Seering, Lake, MI (US)

(73) Assignee: New Image Designs, LLC, Lake, MI (US)

( * ) Notice: Subject to any disclaimer, the term of this patent is extended or adjusted under 35 U.S.C. 154(b) by 382 days.

(21) Appl. No.: 14/048,794

(22) Filed: Oct. 8, 2013

(65) Prior Publication Data

US 2015/0099421 A1 Apr. 9, 2015

(51) Int. Cl.
*A41C 1/10* (2006.01)

(52) U.S. Cl.
CPC ..... *A41C 1/10* (2013.01)

(58) Field of Classification Search
CPC ..... A41C 1/10; A41D 1/20; A61F 5/03
USPC ..... 2/92; 128/99.1, 100.1, 101.1
See application file for complete search history.

(56) References Cited

U.S. PATENT DOCUMENTS 2,587,450 A * 2/1952 Ericsson ..... A41C 1/10 450/111
2,840,822 A * 7/1958 Ericsson ..... A41C 1/10 450/123
5,179,942 A * 1/1993 Drulias ..... A61F 5/028 128/101.1
2003/0171068 A1* 9/2003 Cosentino ..... A61F 5/03 450/155
2009/0142988 A1* 6/2009 Goodman ..... A41C 1/10 450/155
2013/0072087 A1* 3/2013 Chen ..... A41D 1/20 450/155

OTHER PUBLICATIONS

SAI Comfort Fit Maternity Support, braceplanet.com.
Gabrialla Medium Support Elastic Maternity Belt with Pocket Assorted Colors, Target.com.
Medela Maternity Support, Walgreens.com.
Gabrialla Elastic Maternity Belt, Hayneedle.com.
Maternity Support Belt, Allegro Medical Supplies.
Maternity Belts, Curad.
Maternity Shapewear & Support Solutions, Destination Maternity.
Maternity Support Belt, Motherhood Maternity.

* cited by examiner

*Primary Examiner* — Gloria Hale
(74) *Attorney, Agent, or Firm* — Mitchell Intellectual Property Law, PLLC

(57) ABSTRACT

An under belly support belt including a lumbar support portion joined to an under belly support portion, in which the lower edge of the under belly support mid the lower edge of the lumbar support are joined at an angle. When worn, the bottom edge of lumbar portion terminates at each end above the iliac crests of the pelvic girdle, where it merges with the under belly support, allowing the under belly support to descend generally in front of the pelvic girdle and under the belly.

11 Claims, 8 Drawing Sheets

UNDER BELLY SUPPORT BELT

FIELD OF THE INVENTION

The present invention relates to the field of under belly support belts, such as pregnancy support belts or pendulous abdomen supports. Such garments typically comprise some type of wide belt designed to pass around the lower portion of the belly (abdomen) and then around the lower back. They may include an over belly strap extending over the belly from one side of the belt to the other side of the belt.

SUMMARY OF THE INVENTION

The present invention comprises an under belly support belt including a lumbar support portion joined to an under belly support portion, in which the lower edge of the under belly support and the lower edge of the lumbar support are joined at an angle, such that when worn, the bottom edge of lumbar portion terminates at each end above the iliac crests of the pelvic girdle, where it merges with the under belly support, allowing the underbelly support to descend generally in front of the pelvic girdle and under the belly.

These and other features, objects, and advantages of the invention will be more fully understood and appreciated by reference to the embodiments described below and illustrated in the appended drawings.

DESCRIPTION OF EMBODIMENTS OF THE INVENTION

Figure 1:
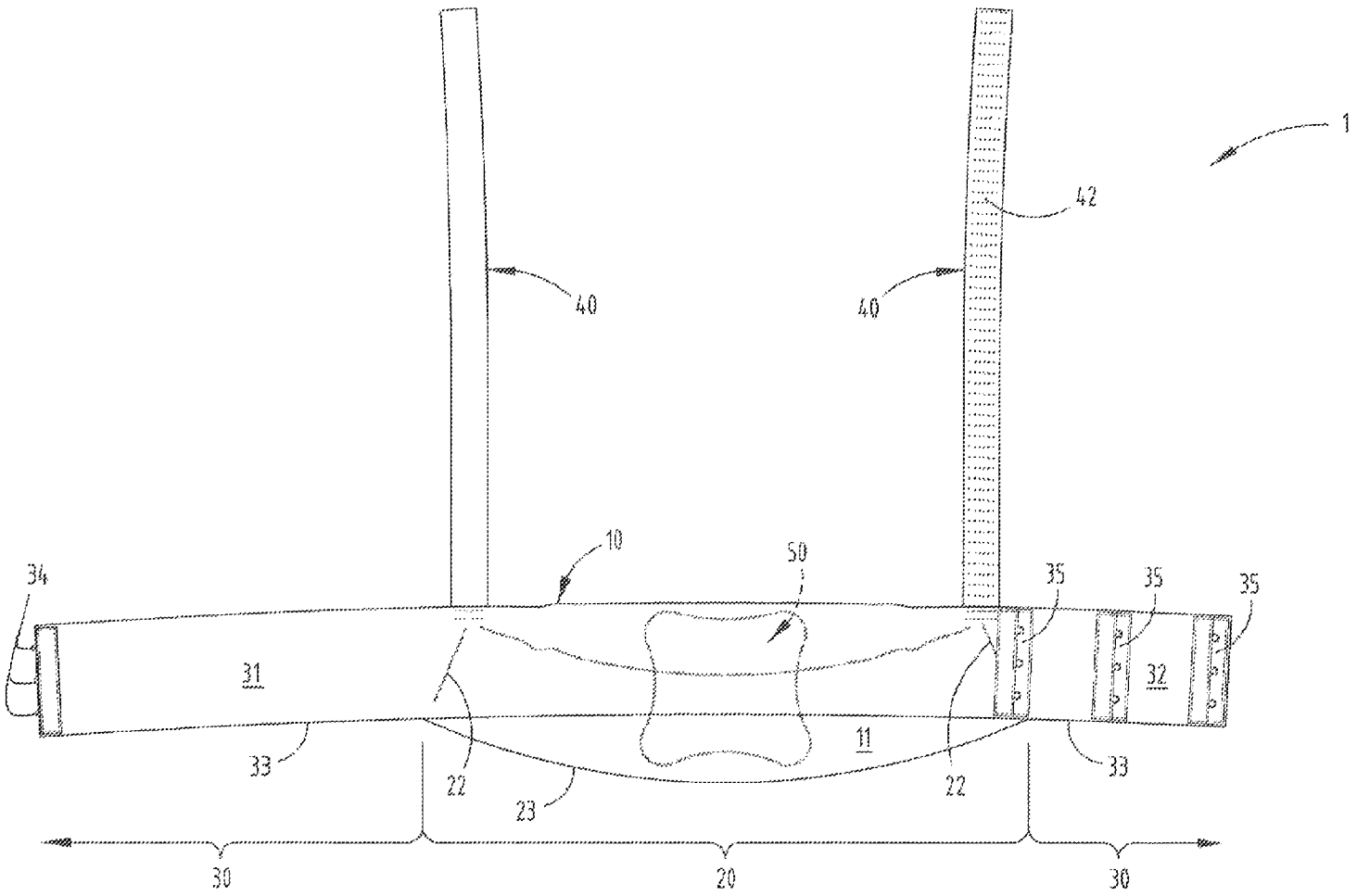
FIG. 1 is a plan view of the body facing surface of the under belly support belt of an embodiment of the invention.
Figure 1A:
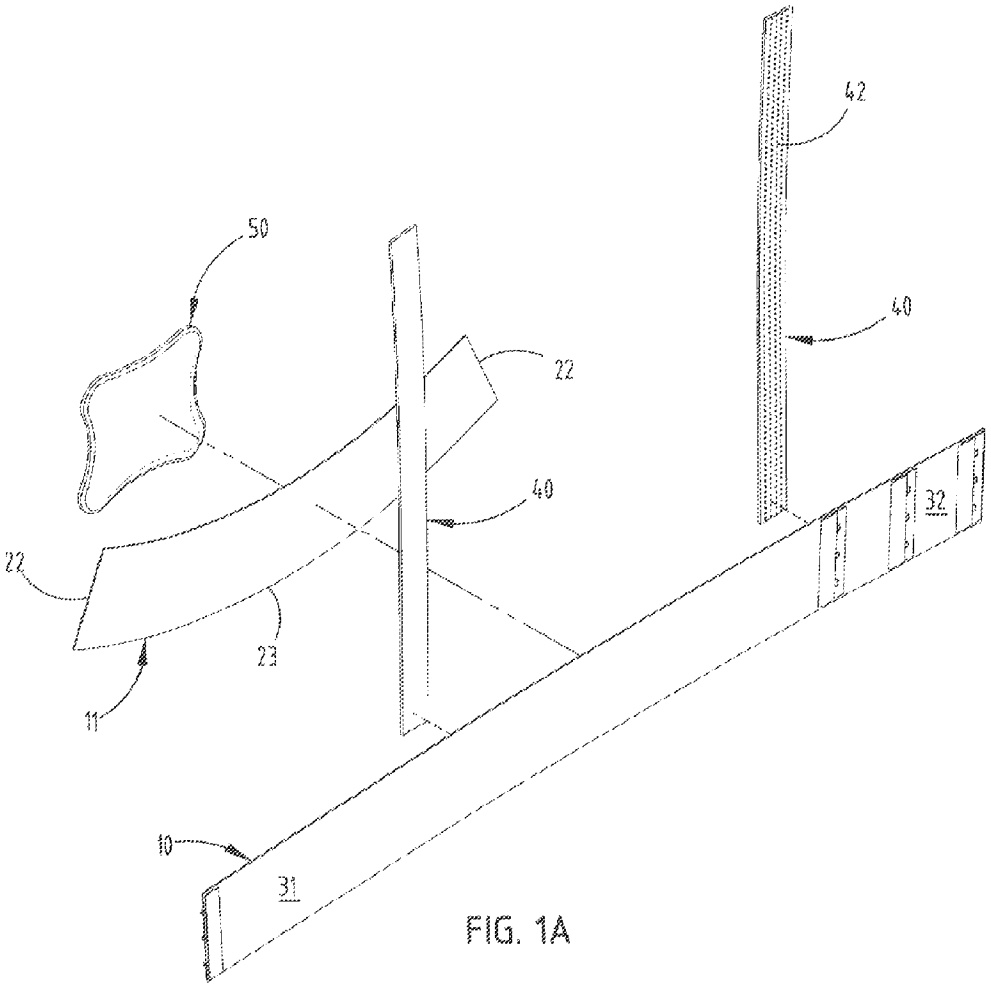
FIG. 1A is an exploded view of FIG. 1.
Figure 2:
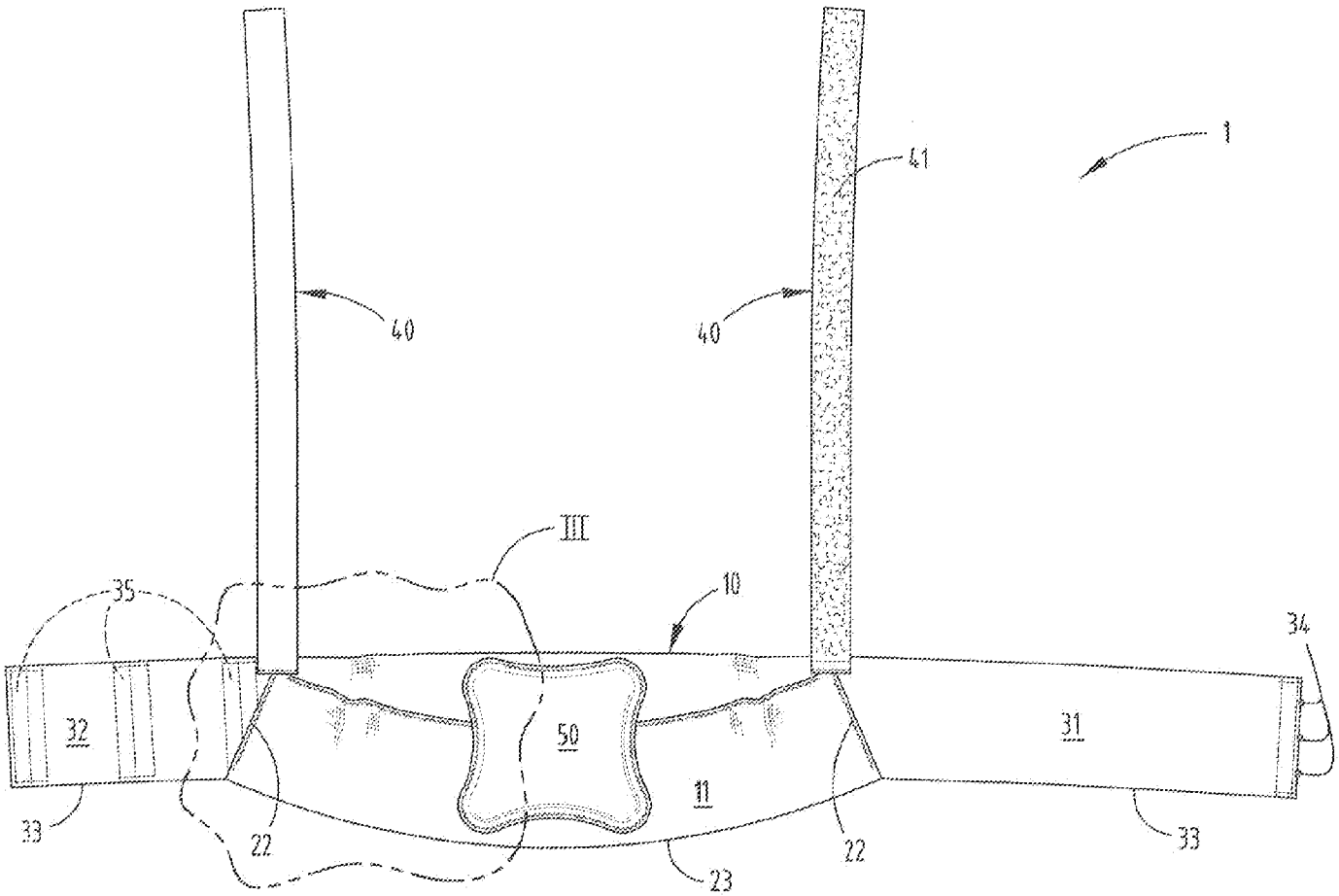
FIG. 2 is a plan view of the outwardly facing surface of the under belly support belt.

The embodiment of the underbelly support invention shown herein is described as a pregnancy belt. As shown and described, the under belly support belt comprises a first elastic band 10 and second elastic band 11 are joined together to define the back support, or lumbar support portion 20 of the under belly support belt 1. The portions of first strap 10 extending beyond the ends 22 of second band 11 comprise the under belly support portion 30 of under belly support, belt 1 (FIGS. 1, 1A, & 2). Under belly support 30 is comprised of the first end portion. 31 and second end portion 32 of first band 10, which extend beyond the ends 22 of second band 11. Ends 22 also comprise the junction of lumbar support 20 with under belly support 30. Over the belly straps 40 are joined at least to elastic band 10 at the junction 22 of back portion 20 with under belly support portions 30. An optionally detachable member 50 is attached or attachable to the body facing side of lumbar support 30. Member 50 is a either a cushioning back pad, or a thermal pack. When they are detachable and re-attachable, both can be used in the alternative.

Figure 9:
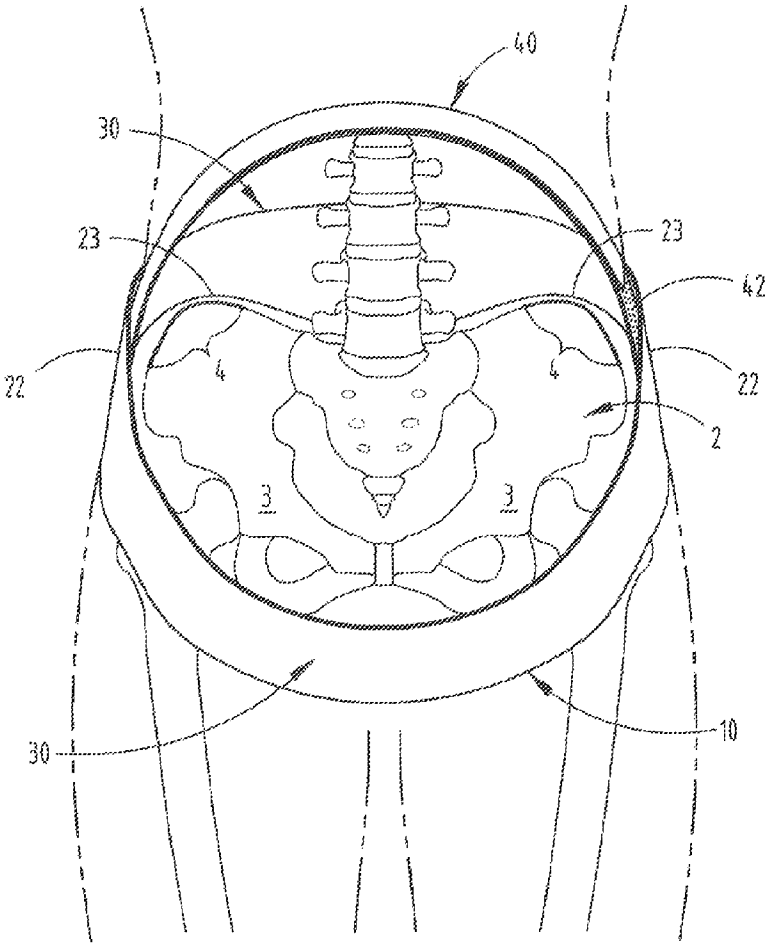
FIG. 9 is a front perspective view of a user wearing the belt, with body lines shown in phantom, and the female pelvic girdle shown exposed, and thereby showing the spatial relationship of the belt to the pelvic girdle when in use.

First strap 10 and second band 11 are made of the same medical grade elastic material. To facilitate manufacture, first band 10 and second band 11 are of the same width, and can be cut from the same starting band material. Second band 11 is joined to first band 10 in an arcuate configuration, such that the ends 22 of second band 11 are contained within, the width of first band 10. Second band 11 then carves downwardly from first band 10 such that the width of the back portion 20 which the two joined bands 10 and 11 define is just slightly less than twice the width of each of first and second bands 10 and 11. The length of the lumbar support portion 20 is such that it extends all the way through the lumbar region and forwardly along the sides of the user, such that as worn, its junction with, under belly support 30 is located just above and towards the front of the iliac crest 4 of the pelvic girdle 2 (FIG. 9).

Figure 3:
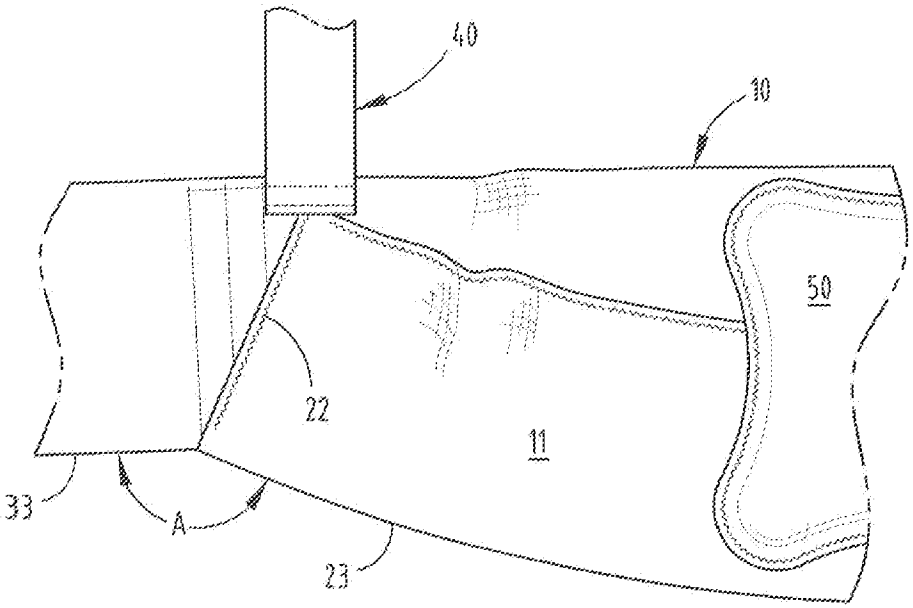
FIG. 3 is a close-up of the junction of the body facing surface of the lumbar and under belly support portions.
Figure 5:
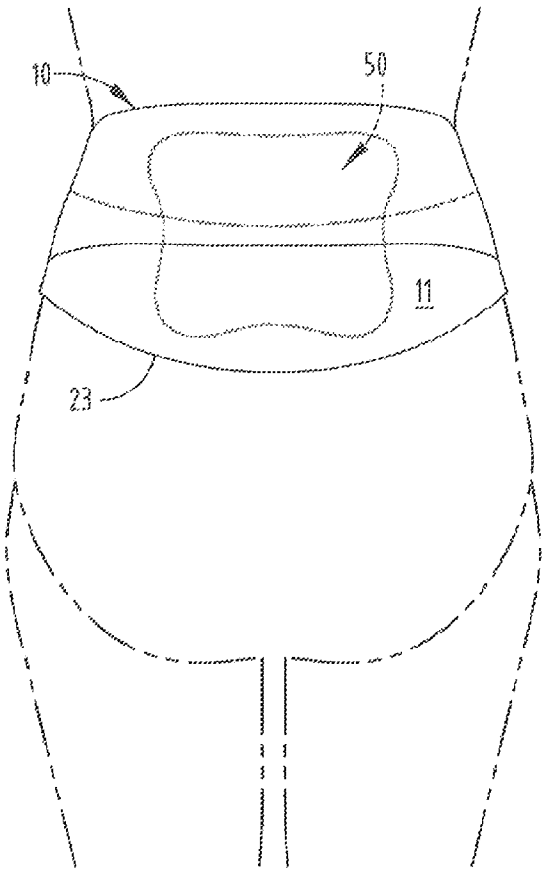
FIG. 5 is a rear perspective view of the under belly support belt being worn.
Figure 4:
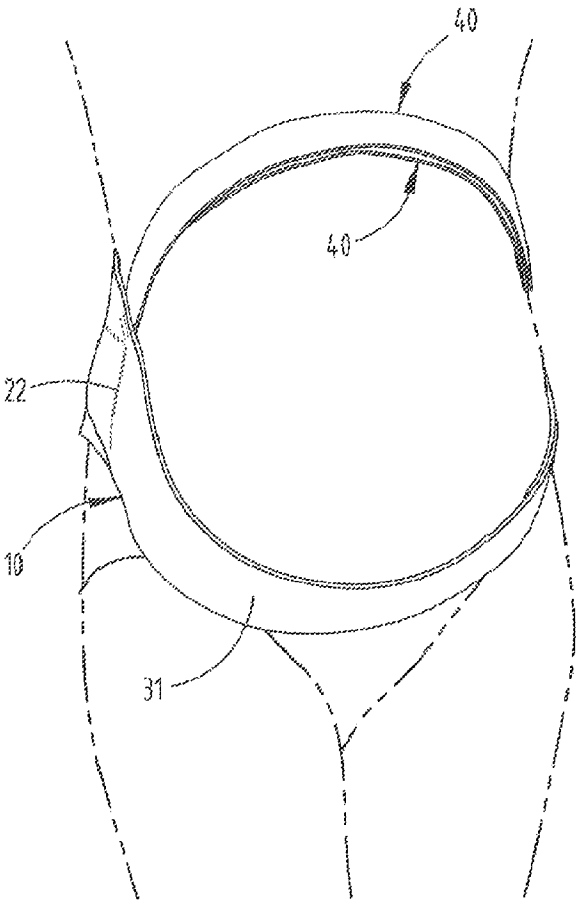
FIG. 4 is a front perspective view of the under belly support belt being worn.
Figure 7:
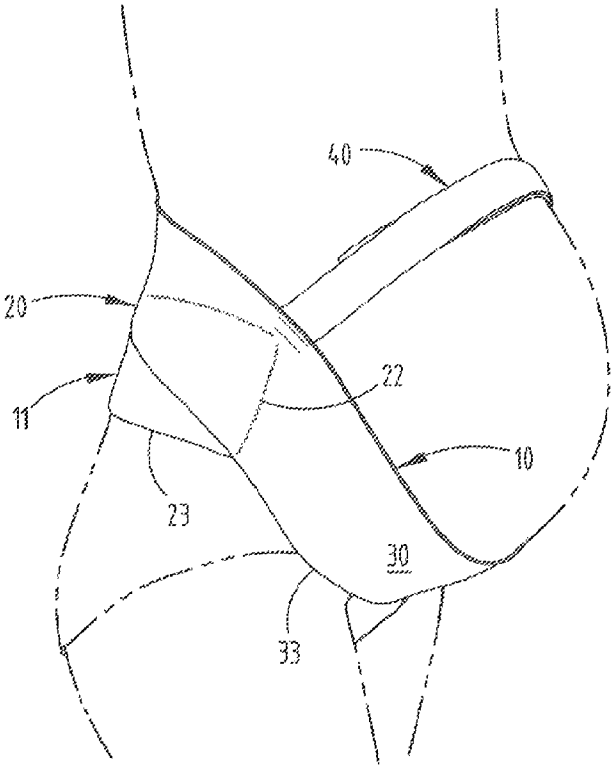
FIG. 7 is a right side perspective view of the under belly support belt being worn.
Figure 6:
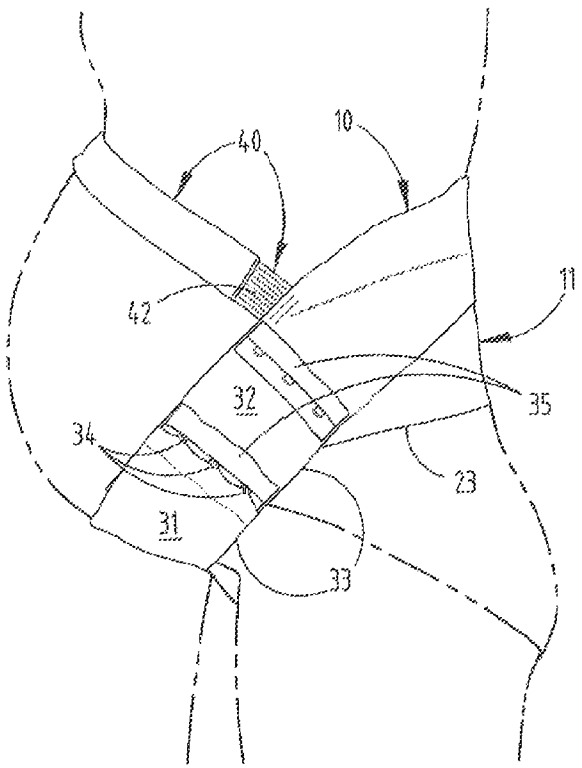
FIG. 6 is a left side perspective view of the under belly support belt being worn.

The lower edge 23 of lumbar support 20 forms an obtuse angle A with the bottom edge 33 of under belly support bands 31 and 32, at the junctions 22 of lumbar support 20 with under belly support 30 (FIG. 3). This allows the junction region 22 to be positioned higher on the body, generally above the iliac crest 4, and allows the under belly support 30 to descend downwardly from junction 22 and around the bottom of the abdomen. To increase comfort the lower edge 23 of lumbar support 20 is arcuately shaped so as to follow approximately the arcuate curvature of the top of the back of the pelvic girdle when worn. The lower edge 23 curves upwardly in both directions away from the widest point of lumbar support 20, to its juncture with the lower edges 33 of under belly support 30, such that said juncture is located approximately above iliac crest on each side when the belt 1 is worn.

Figure 8:
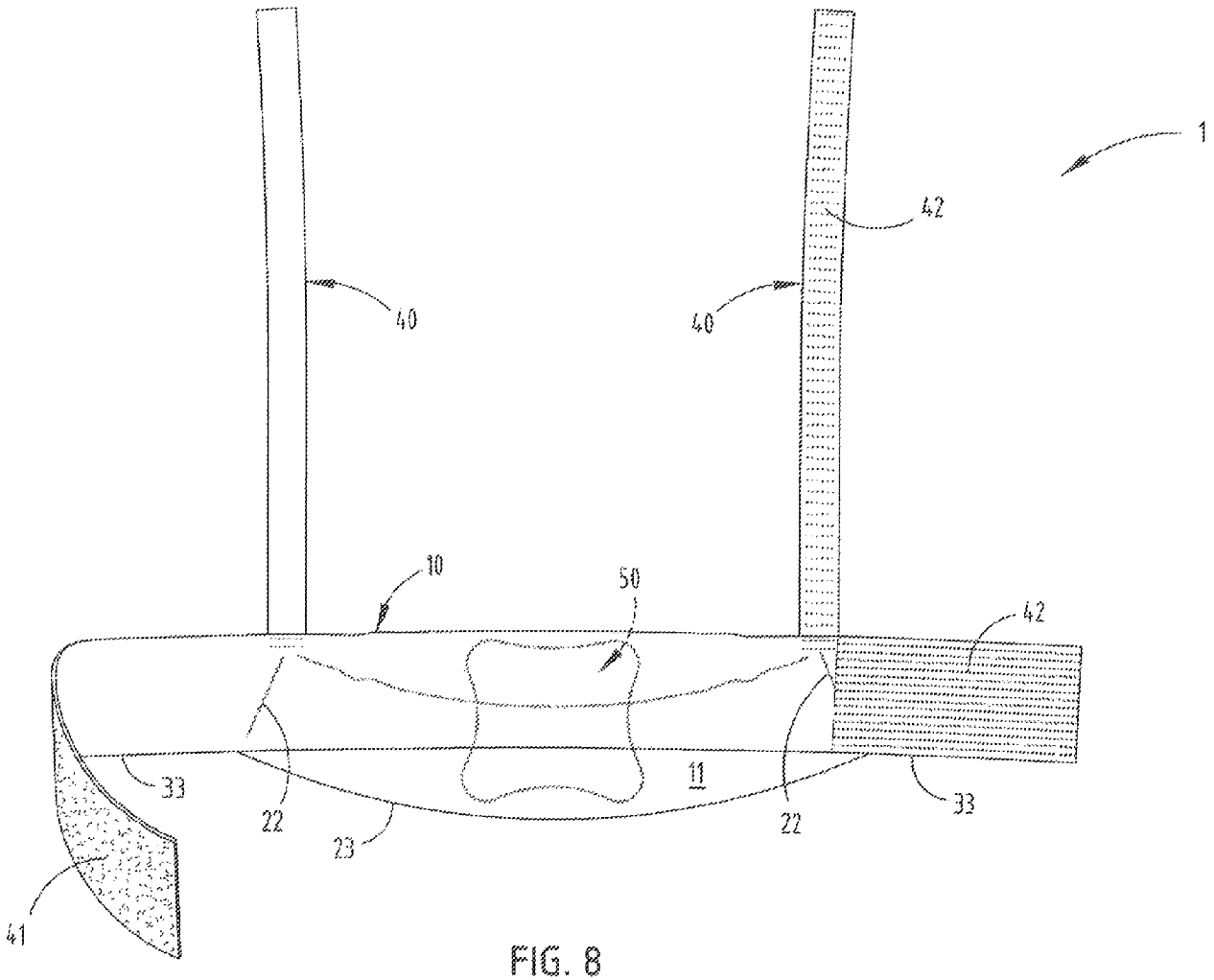
FIG. 8 is apian view of an alternative embodiment in which the belt ends are secured by hook and loop fabric fasteners.

Under belly support band portion 31 includes three books 34 at its end. (FIG. 1). Under belly support band portion 32 includes three separate rows 35 of loops (more or fewer rows may be used), into which hook fasteners 34 can be hooked. The use of multiple rows 35 of loops provides under belly support 30 with adjustability to accommodate the most comfortable support tension as well as different belly shapes as pregnancy proceeds, or the shape of the belly otherwise changes. In an alternative embodiment shown in FIG. 8, the undersurface of belly support band portion 31 is provided with hook fabric 36, while the upper surface of under belly support baud portion 32 is provided with a loop fabric 37, such that a hook and loop attachment connection can be made at various different points, facilitating the adjustability of the overall length of under belly support 30.

Over belly straps 40 are either permanently or detachably secured to first strap 10 at the junction 22 between, lumbar support region 20 and under belly support bands 31 and 32, respectively. Over belly straps 40 are sufficiently long that they overlap over the top of the belly. In the embodiment shown, one includes a fabric hook surface 41 and the other includes a fabric loop surface 42 (FIGS. 1, 2). As shown, the hook surface 41 of belly strap 40 lies on the body facing surface of the strap, while the loop surface 42 of the other belly strap 40 lies on the surface of strap 40 facing away from the body (compare FIGS. 1, 2). The provision of a continuous fastening surface over the overlapping portions of over belly straps 40 allows one to adjust the tension in the over belly straps 40, as well as to adjust for differences in the shape of the belly as pregnancy or other changes in belly shape progress.

Back pad 50 provides additional padding in the central portion of lumbar support 20, on the side thereof which faces the body of the user. It is made of a soft cushiony material. Optionally, back pad 50 can be made detachable and re-attachable to lumbar support 20, using, for example, hook and loop fabric fastening surfaces.

In one embodiment, an opening can be left at the top of back pad 50, such that a small thermal pack can be inserted into the pocket thus defined by back pad 50 on lumbar support 20. In yet another embodiment, member 50 could itself comprise a detachable thermal pack. Such a thermal pack could be made cold, hot or in between. It would preferably contain a gel which can be chilled in a freezer without becoming solid, or could be heated in hot water or in a microwave. By using a detachable and re-attachable thermal pack 50 and a detachable and re-attachable back pad 50, the user could alternate between providing a thermal surface against her lumbar or a softer more resilient back pad surface.

In use, under belly support band 1 is strapped on such that lumbar support region 20 engages and extends across the lumbar region of the back, and under belly support band 30 extends downwardly from its junction 22 with lumbar support region 20 (FIGS. 4-7). The two bands 31 and 32 are fastened together by engaging hooks 34 with one of the multiple rows 35 of loops which are provided. The provision of multiple spaced rows 35 of loops allows adnominal support 30 to be adjustably fastened, to provide comfortable support at the proper tension in adnominal support 30, and to accommodate different shapes of the belly as pregnancy or other changes in belly shape proceed.

The dimensions of the various components making up under belly support belt 1 are determined with reference to various physical dimensions of the user's body. Accordingly, a manufacturer will provide under belly support belts 1 of several different sizes, to accommodate a variety of different body sixes.

FIG. 9 shows the desired dimensions of under belly support belt 1 relative to the female pelvis 2. The female pelvis 2 comprises an ilium 3 on the left and right sides respectively of the pelvis. The upper curved portion 4 of each ilium is referred to as the iliac crest. From a low point in the back, the upper edge of each, ilium rises towards the iliac crest 4, and then descends downwardly from die iliac crest as the ilium proceeds towards the front of the person, in under belly support belt 1, the lower edge 23 of lumbar support region 20 is arcuately shaped so as to follow approximately the arcuate curvature of the top and back of the pelvic girdle. The lower edge 23 of lumbar support 20 curves upwardly to its juncture 22 with under belly support 30, located approximately above iliac crest 4 when belt 1 is worn by the user. The obtuse angle A between the lower edge 23 of lumbar support 20 and the bottom edge 33 of under belly support 30 allows the under belly support, bands 30 to then descent downwardly in front of the descending ilium to the point at which band portions 31 and 32 fasten together, in this manner, under belly support belt 1 tends to be anchored above the iliac crest in use, thus minimizing the ability of the belt to slip downwardly. This, along with the dimensions for the width of under belly support 30, help prevent the under belly support of this embodiment of the invention from digging into a woman's legs when she moves about or is seated.

The arcuate shape of the bottom edge 23 of lumbar support 20 is selected such that the curvature of the lumbar support region follows generally the curvature of the rear upper edge of the pelvic girdle 2. Angle A is selected such that under belly support band 30 descends comfortably downwardly in front of the pelvic girdle to comfortably support the lower portion of the woman's abdomen. In the embodiment shown, the "at rest" obtuse angle A is approximately 155°, lying someplace between 153-157°. This "at rest" angle could vary from about 140° to about 170°, or more preferably from about 150° to about 160° to accommodate various different body shapes. For men, the angle A will tend to be greater, as men generally have taller iliums and higher iliac crests.

The term "at rest" with respect to angle A refers to angle A when under belly support belt 1 is not in use. In use, the elasticity of bands 10 and 11 will allow the user to vary angle A somewhat from its at rest value. This allows a user the ability to vary angle A from its at rest value, in order to comfortably position under belly support 30 specifically in accordance with the user's body. In use, for example, the lumbar support and under belly support might be positioned relative to one another such that angle A is 140°, even though in its as manufactured at rest condition, the angle is about 155°.

Under belly support 30 should be wide enough to provide comfortable, lifting support for the bottom of the abdomen. In most cases, it should be about the width of the user's hand. It should lift the bottom of the abdomen as if the user were lifting her abdomen by clasping her hands under her abdomen. For exceptionally large bellies, it may have to be wider.

The width of lumbar support area 20 should be wide enough to comfortably distribute the lifting force created, by the under belly support 30, but narrow enough, especially towards its junction with under belly support 30, that the bottom edge of belt 1 at the junction 22 of lumbar support 20 with under belly support 30 rises up and over the iliac crest of the pelvic girdle. This helps anchor the belt and minimize the possibility that it will slip down, winch would be both uncomfortable, and possibly lead to the belt cutting off circulation to and from the legs when the woman is seated.

The over belly straps 40 are sufficiently wide that they rest comfortably on the top of users belly when joined, yet sufficiently narrow that they are easily joined.

In order to accommodate different body sizes and shapes, under belly support band 1 will be made with differing dimensions, in order to have the relative dimensions discussed above. Thus, for example, at its widest point, lumbar support 20 will vary from about 3" to about 19.5". Most users will fall within a range of about 5"-10".

The width of the under belly support will vary from about 2" to about 9", with most users failing within, the width range of about 3" to about 7" The over belly straps will typically be approximately 1" in width. However in the various models, they will range from about ½" to about 2" in width.

The length of the lumbar support area 20 will range from about 10 to about 32'. For most users the length will probably fall, between about 12 to about 20". The length of the under belly support portion will vary from about 12 to about 28", when the two ends are secured. For most users the length will probably fall between about 15 to about 25'.

Preferably, one of the under belly support bands, e.g. band 31, is longer than band 32, so that it wraps completely under the protruding abdomen before it couples to the shorter band 32. However, the relative lengths of under belly support band 31 and under belly support band 32 can vary from 50:50, such that they fasten underneath the abdomen, to 90:10 such that they fasten more at the user's side. A more typical range would be from, about 70:30 to about 85:15.

To use under belly support belt 1, the user attaches a back pad 50 or thermal pack 50 to lumbar support 20, on the body facing surface thereof. Alternatively, back pad 50 may be permanently attached except for an opening at the top, allowing the insertion of a thermal pack within the pocket defined by that opening and back pad 50. With belt 1 thus prepared, the user arranges it so that lumbar support area 20 is centered in the lumbar region of her back, and brings the free ends of under belly support bands 31 and 32 around to her front. She adjusts the bands so that the junction 22 between lumbar support 20 and under belly support 30 is positioned generally above the iliac crests of her pelvic girdle. She then brings under belly support 30 under her abdomen and secures the ends of bands 31 and 32 together. She may also utilize over belly straps 40 to lift or hold junction areas 22 a little higher, helping to make sure that they are above the iliac crests 4. She secures the straps 40 together with an amount of tension that is appropriate to her.

Of course, it is understood that the foregoing are exemplary embodiments of the invention and that various changes and alterations can be made without departing from the spirit and broader aspects of the invention as set forth in the attached claims, as interpreted in accordance with the United States patent laws, including the doctrine of equivalents.

The invention claimed is:

1. An under belly support belt comprising: a lumbar support portion having upper and lower edges; an under belly support portion having upper and lower edges and a width there between; said lumbar support portion being configured to extend across a user's lumbar region and around to the user's sides when worn; said lumbar support portion and said under belly support being joined at a junction, with their respective said lower edges being at an obtuse angle, such that when worn, said lower edge of said lumbar portion terminates above the iliac crests of the user's pelvic girdle, and said under belly support portion descends downwardly from its said junction with said lumbar support portion generally in front of the user's pelvic girdle and under the user's abdomen; and configured said lower edge of said lumbar support portion being arcuately shaped so as when worn, to follow approximately the arcuate curvature of the top of the back of a user's pelvic girdle, said lower edge of said lumbar support portion curving upwardly to said juncture with said under belly support portion; said under belly support being configured such that said width of said under belly support portion from said lower edge of said under belly support portion to said upper edge of said under belly support portion is approximately the width of an intended user's hand.

2. The under belly support belt of claim 1 in which said obtuse angle when said belt is not in use when laid out flat is from about 140° to about 170°.

3. The under belly support belt of claim 2 which includes a pair of over belly support straps configured to extend over the top of a user's belly when said belt is worn, one attached to each said junction of said lumbar support portion with said under belly support portion; said over belly straps having free ends and sufficient length to overlap in use at their said free ends, and including mating fasteners along at least a portion of their said lengths extending from their said free ends, thus allowing a user to adjust the tension in said over belly support straps as well as to adjust for differences in the shape of the belly.

4. The under belly support belt of claim 2 in which said under belly support portion comprises two separate bands, one extending from each end of said lumbar support portion; said separate bands having relative lengths of from 50:50 to 90:10.

5. The under belly support belt of claim 2 in which said under belly support portion comprises two separate bands, one extending from each end of said lumbar support portion; said separate bands having relative lengths of from 70:30 to 85:15.

6. An under belly support belt comprising: a lumbar support portion having upper and lower edges and a body facing surface oriented to face a user's body when worn; an under belly support portion having upper and lower edges; said lumbar support portion being configured to extend across a user's lumbar region and around to the user's sides when worn; said lumbar support portion and said under belly support portion being joined at a junction with their said lower edges being at an obtuse angle, such that when worn, said under belly support portion descends downwardly from its said junction with said lumbar support portion whereby it can support portion the lower portion of the user's abdomen; said lumbar support portion and said under belly supports being made of first and second bands of elastic material, each having a length, a substantially uniform width and ends, said first band being longer than said second band; said second band being secured to said first band in an arcuate configuration to define said lumbar support portion; said ends of said first band extending beyond said ends of said second band to define two separate portions of said under belly support; said ends of said first band being releasably attachable to one another; said ends of said second band defining the juncture between said lumbar support and said under belly support.

7. The under belly support belt of claim 6 in which said first and second bands are of the same width and are made of the same material.

8. The under belly support of claim 6 which includes a back pad which is detachable and re-attachable to said body facing surface of said lumbar support portion.

9. The under belly support of claim 6 which includes a back pad attached to said body facing surface of said lumbar support portion, said back pad including an opening at the top of said back pad to define a pocket between said back pad and said lumbar support portion, such that a separate thermal pack can be heated or cooled and inserted into said pocket.

10. The under belly support of claim 6 which includes a detachably mounted thermal pack which can be separately heated or cooled and attached to said lumbar support portion on said body facing surface thereof.

11. An under belly support belt comprising: first and second bands of elastic material, each having a length, a uniform width and ends, said first band being longer than said second band; said second band being secured to said first band in an arcuate configuration so as to extend below said first band to define with said first band a lumbar support portion; said ends of said first band extending beyond said ends of said second band to define two separate portions of an under belly support portion; said ends of said first band being releasably attachable to one another said ends of said second band defining the junction between said lumbar support portion and said under belly support portion; a pair of over belly support straps configured to extend over the top of a user's belly when said belt is worn, one attached to each said junction of said lumbar support portion with said under belly support portion; said over belly straps being configured to have free ends and sufficient length to overlap in use at their said free ends, and including mating fasteners along at least a portion of their said lengths extending from their said free ends, thus allowing a user to adjust the tension in said over belly support straps as well as to adjust the combined length of said over belly support straps when overlapped and fastened when said under belly support belt is worn.

* * * * *